US007344398B2

(12) United States Patent
Sibout

(10) Patent No.: US 7,344,398 B2
(45) Date of Patent: Mar. 18, 2008

(54) SAFETY LOCKING SOCKET FOR LIGHT TUBE

(75) Inventor: Michel Sibout, Veniers (FR)

(73) Assignee: C.E.I.T. Corp., Plattsburgh, NY (US)

( * ) Notice: Subject to any disclaimer, the term of this patent is extended or adjusted under 35 U.S.C. 154(b) by 0 days.

(21) Appl. No.: 11/513,652

(22) Filed: Aug. 30, 2006

(65) Prior Publication Data

US 2007/0049123 A1 Mar. 1, 2007

Related U.S. Application Data

(60) Provisional application No. 60/713,914, filed on Sep. 1, 2005.

(51) Int. Cl.
*H01R 33/02* (2006.01)
*H01R 33/08* (2006.01)

(52) U.S. Cl. ..... 439/232; 439/375

(58) Field of Classification Search ..... 439/232, 439/238, 240, 336, 220, 242, 375, 356; 362/260
See application file for complete search history.

(56) References Cited

U.S. PATENT DOCUMENTS 3,781,759 A * 12/1973 Shelly, Jr. ..... 439/232
6,769,789 B1 * 8/2004 Won et al. ..... 362/260
6,824,409 B2 * 11/2004 Thiele et al. ..... 439/242
6,890,199 B2 * 5/2005 Vogt et al. ..... 439/238
7,097,327 B1 * 8/2006 Barton ..... 362/260

FOREIGN PATENT DOCUMENTS

JP 06290620 A * 10/1994

* cited by examiner

*Primary Examiner*—Hae Moon Hyeon
(74) *Attorney, Agent, or Firm*—Carter & Schnedler, P.A.

(57) ABSTRACT

A luminaire socket is used in spaced-apart pair to receive a light tube therebetween in a luminaire assembly. The light tube has socket caps with contact pins at opposed ends. The luminaire socket comprises: a base connected to a support surface; electrical plugs within the base, the electrical plugs connected to a power source to provide power to a light tube; a socket connector operatively connected to the base, the socket connector having a slot for receiving the contact pins of a light tube in a locking position in which the contact pins of the light tube are in electrical contact with the electrical plugs for actuation of the light tube; and at least one support wall on the rotor connector, the support wall being displaceable to a support position by engagement of the light tube in the luminaire socket to support the light tube when the light tube is accidentally disengaged from the socket connector in the locking position.

6 Claims, 8 Drawing Sheets

SAFETY LOCKING SOCKET FOR LIGHT TUBE

CROSS-REFERENCE TO RELATED APPLICATION

The present patent application claims priority on U.S. Provisional Patent Application No. 60/713,914, filed on Sep. 1, 2005, by the present applicant.

BACKGROUND OF THE INVENTION

1. Field of the Invention

The present invention relates to luminaire assemblies and, more particularly, to a luminaire socket of a luminaire assembly used to support light tubes in various applications, including non-exclusively transit vehicles, residential, industrial and commercial buildings.

2. Background Art

Luminaire assemblies are a well known and used type of lighting fixture. Luminaire assemblies are an efficient source of light and hence often used in large area premises, such as commercial, industrial and residential buildings. The efficient energy consumption of luminaire assemblies has resulted in luminaire assemblies being used in passenger areas of transit vehicles, such as buses, trains, subways and the like.

As such, luminaire assemblies must be constructed in view of conditions associated with such environments. For example, the luminaire assemblies may be subjected to constant vibrations. Accordingly, the construction of a luminaire assembly must take into account these conditions to prevent incidents, such as the disengagement of light tubes from sockets of the luminaire assemblies. Additionally, luminaire assemblies must also be constructed in view of given fire-safety and longevity standards.

SUMMARY OF INVENTION

It is therefore an aim of the present invention to provide a luminaire socket that addresses the issues of the prior art.

Therefore, in accordance with the present invention, there is provided a luminaire socket of the type used in spaced-apart pair to receive a light tube therebetween in a luminaire assembly, the light tube being of the type having socket caps with contact pins at opposed ends, wherein the luminaire socket comprises: a base connected to a support surface; electrical plugs within the base, the electrical plugs connected to a power source so as to provide power to a light tube; a socket connector operatively connected to the base, the socket connector having a slot for receiving therein the contact pins of a light tube in a locking position in which the contact pins of the light tube are in electrical contact with the electrical plugs for actuation of the light tube; and at least one support wall on the socket connector, the support wall being displaceable to a support position by engagement of the light tube in the luminaire socket so as to support the light tube when the light tube is accidentally disengaged from the socket connector in the locking position.

BRIEF DESCRIPTION OF THE DRAWINGS

Having thus generally described the nature of the invention, reference will now be made to the accompanying drawings, showing by way of illustration a preferred embodiment thereof and in which.

DESCRIPTION OF THE PREFERRED EMBODIMENTS

Figure 1:
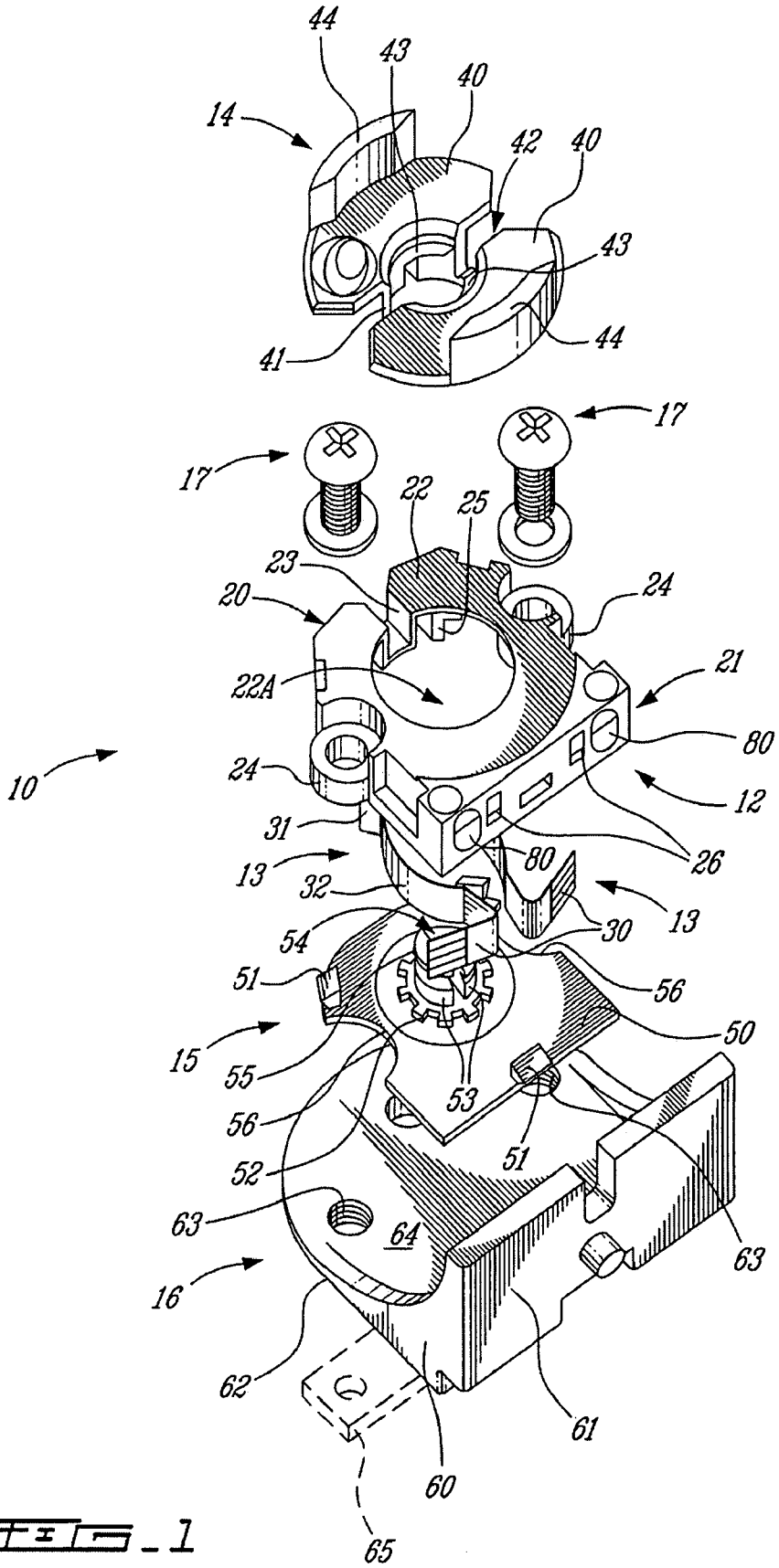
FIG. 1 is an exploded view of a luminaire socket constructed in accordance with a preferred embodiment of the present invention.

Referring now to the drawings, and more particularly to FIG. 1, a luminaire socket in accordance with a preferred embodiment is generally shown at 10. The luminaire socket 10 has a body 12 (i.e., a base), plugs 13, a socket connector 14, a cover 15 and a support 16.

The body 12 is an interface between the various parts of the luminaire socket 10.

The plugs 13 are provided for the electrical connection between the pins of a light tube and supply wires, when the light tube is locked to the luminaire socket 10.

The socket connector 14 is in a preferred embodiment a rotor (hereinafter the rotor 14) operatively connected to the body 12. The rotor 14 receives pins of a light tube, as will be shown hereinafter, and enables electrical contact between the light tube and the luminaire socket 10, by its rotation with respect to the body 12. The rotor 14 also supports the light tube as a safety feature of the luminaire socket 10.

The cover 15 cooperates with the body 12 to accommodate the plugs 13 in the luminaire socket 10. The cover 15 also indexes movement of the rotor 14 with respect to the body 12.

The support 16 is the interface between the socket 10 and a support surface, such as a ceiling, a wall or a support surface with the luminaire assembly. The support 16 also biases a remainder of the socket 10 outwardly, so as to compensate for any play of a light tube between opposite sockets 10.

Figure 2:
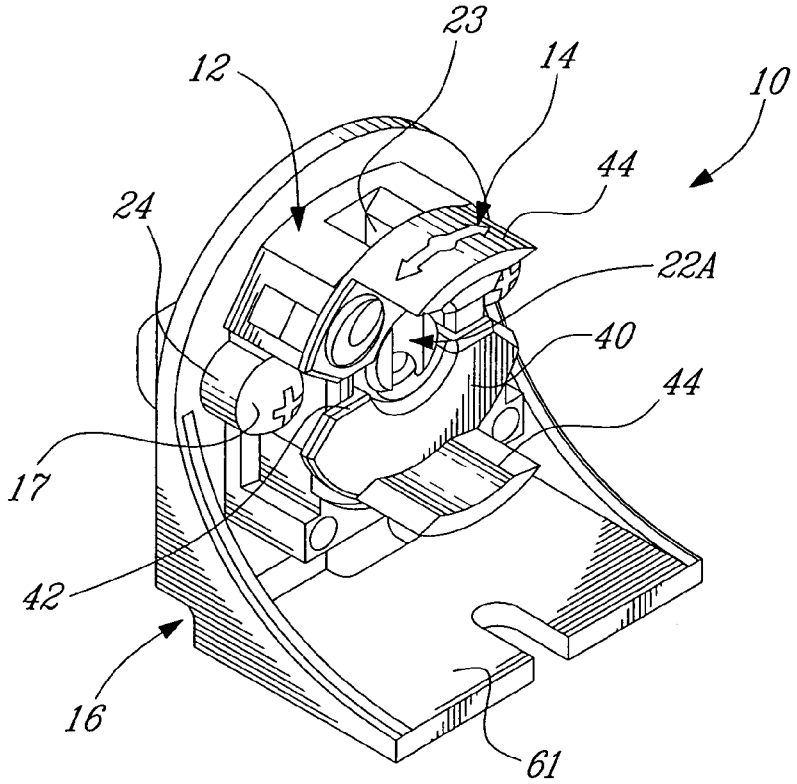
FIG. 2 is a perspective view of the luminaire socket of FIG. 1, as assembled and in a locking orientation.
Figure 3:
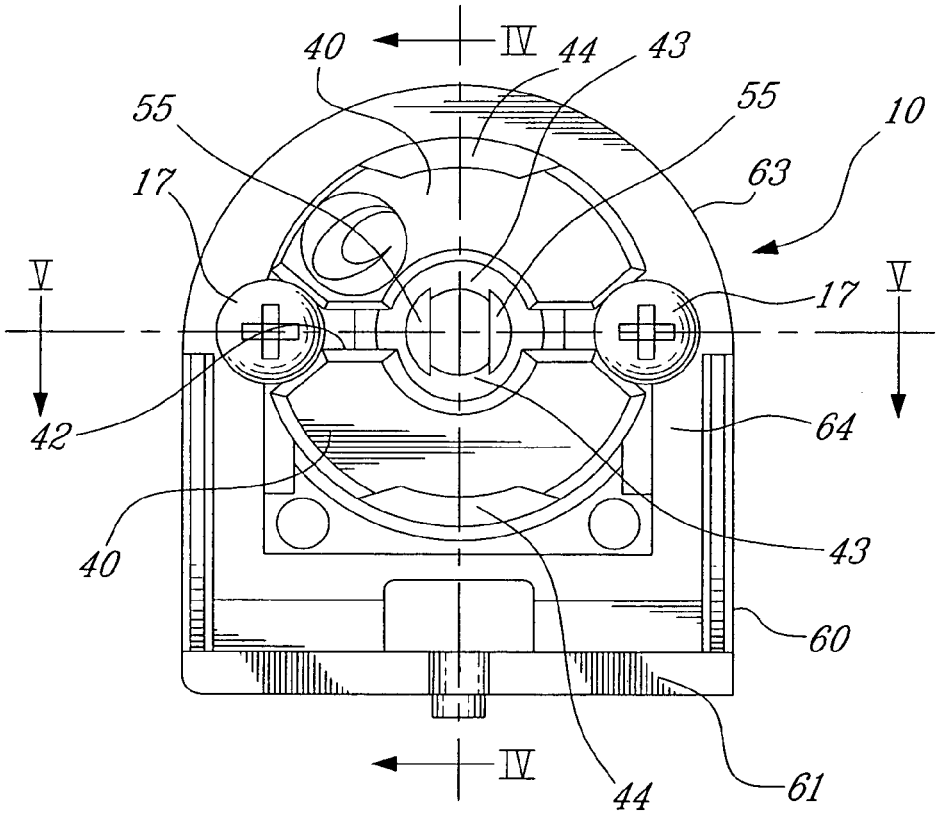
FIG. 3 is an elevation view of a connection face of the luminaire socket of FIG. 1, as assembled and in a locking orientation.
Figure 4:
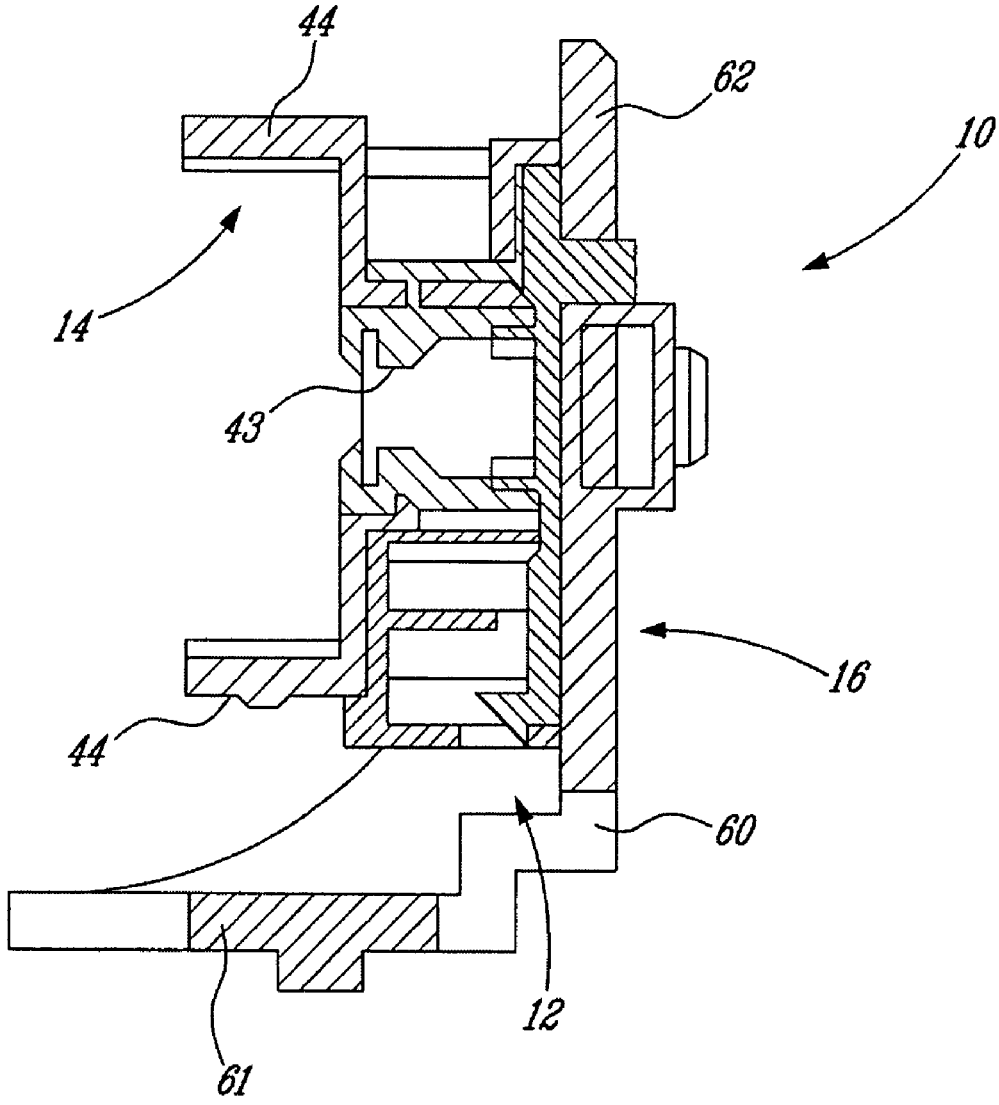
FIG. 4 is a cross-sectional view of the luminaire socket taken along cross-sectional line IV-IV of FIG. 3.
Figure 5:
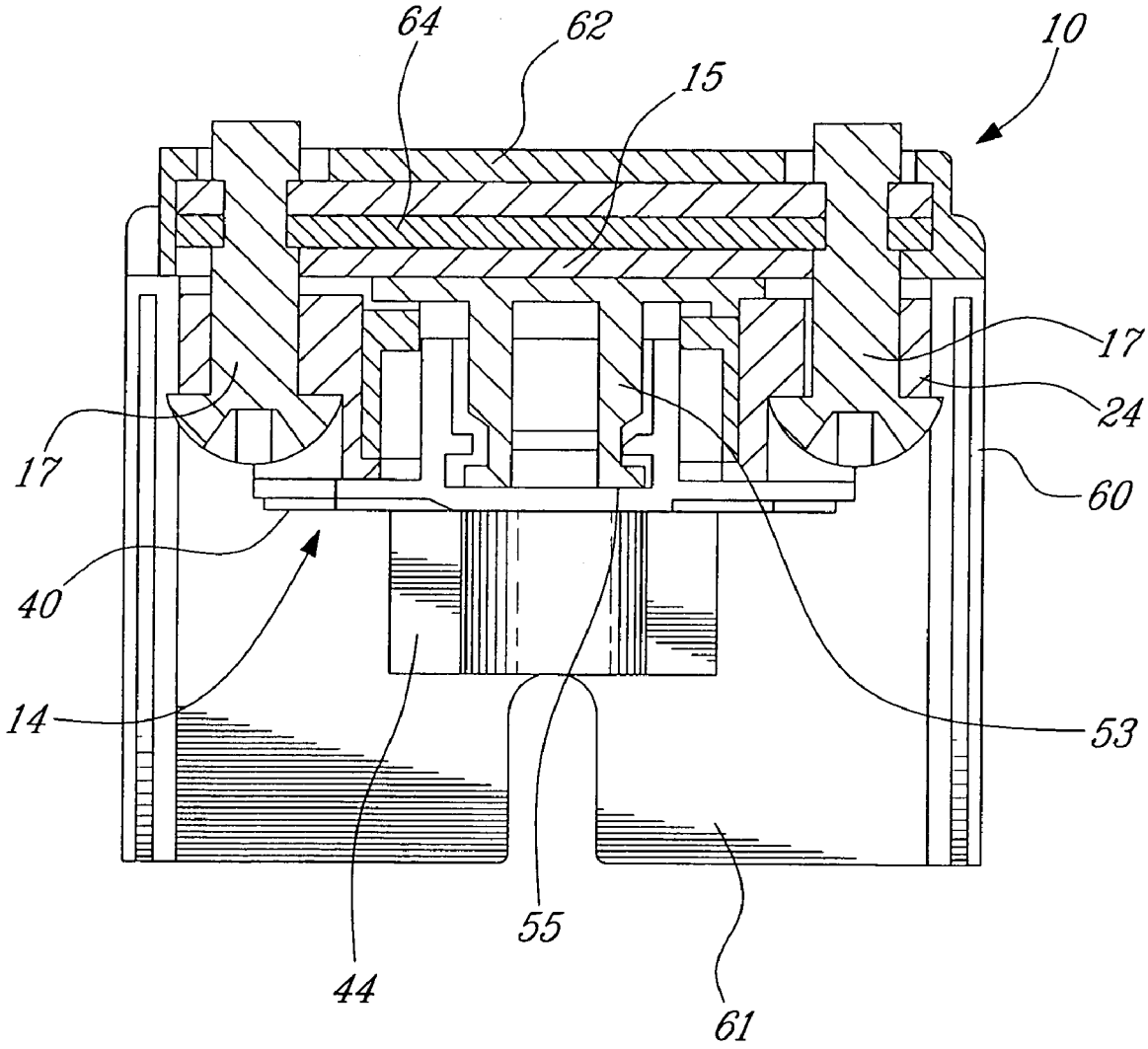
FIG. 5 is a cross-sectional view of the luminaire socket taken along cross-sectional line V-V of FIG. 3.

Fasteners 17 (such as bolts, screws or the like) are provided to connect some of the parts of the luminaire socket 10, as shown in FIG. 2.

Referring to FIG. 1, the body 12 has a tubular portion 20 and a casing portion 21. The tubular portion 20 has a semi-annular surface 22 about a central opening 22A. The surface 22 is generally smooth, as it will serve as a seat for the rotor 14. The surface 22 is disrupted by a slot 23. The slot 23 is provided for the insertion of the pins of a socket cap into engagement with the luminaire socket 10.

A pair of eyelets 24 are provided on opposed sides of the surface 22 so as to receive the fasteners 17, as shown in FIG. 2. The fasteners 17 will be screwingly engaged into the support 16.

The casing portion 21 is provided to partly accommodate the plugs 13. Connectors 25 (only one of which is visible in FIG. 1) project away from the surface 22 within the tubular portion 20. Openings 26 are provided in the casing portion 21 to access the plugs 13. As shown in FIG. 1, the plugs 13 each have an arcuate central contact portion 32 with opposed connector ends 30 and 31.

Accordingly, when the plugs 13 are connected to the body 12, the connector ends 30 of the plugs 13 are lodged in the casing portion 21 in such a way that the connector ends 30 resiliently abut against a surface defining the openings 26.

The connector ends 31 cooperate with the connectors 25 of the body 12. Therefore, when the plugs 13 are secured to the body 12, the central portion 32 of the plugs 13 protrudes into the central opening 22A, so as to be exposed for contact with the pins of a light tube, as will be described hereinafter.

Live ends of wires, associated with a power source (e.g., ballast), are inserted into openings 80 so as to be releasably retained between the connector ends 30 and a surface of the openings 26. Accordingly, contact is made between the plugs 13 and supply wires. The supply wires can be removed by the insertion of a tool (e.g., flat-head screwdriver) in the openings 26, against the biasing action of the plugs 13.

Figure 6:
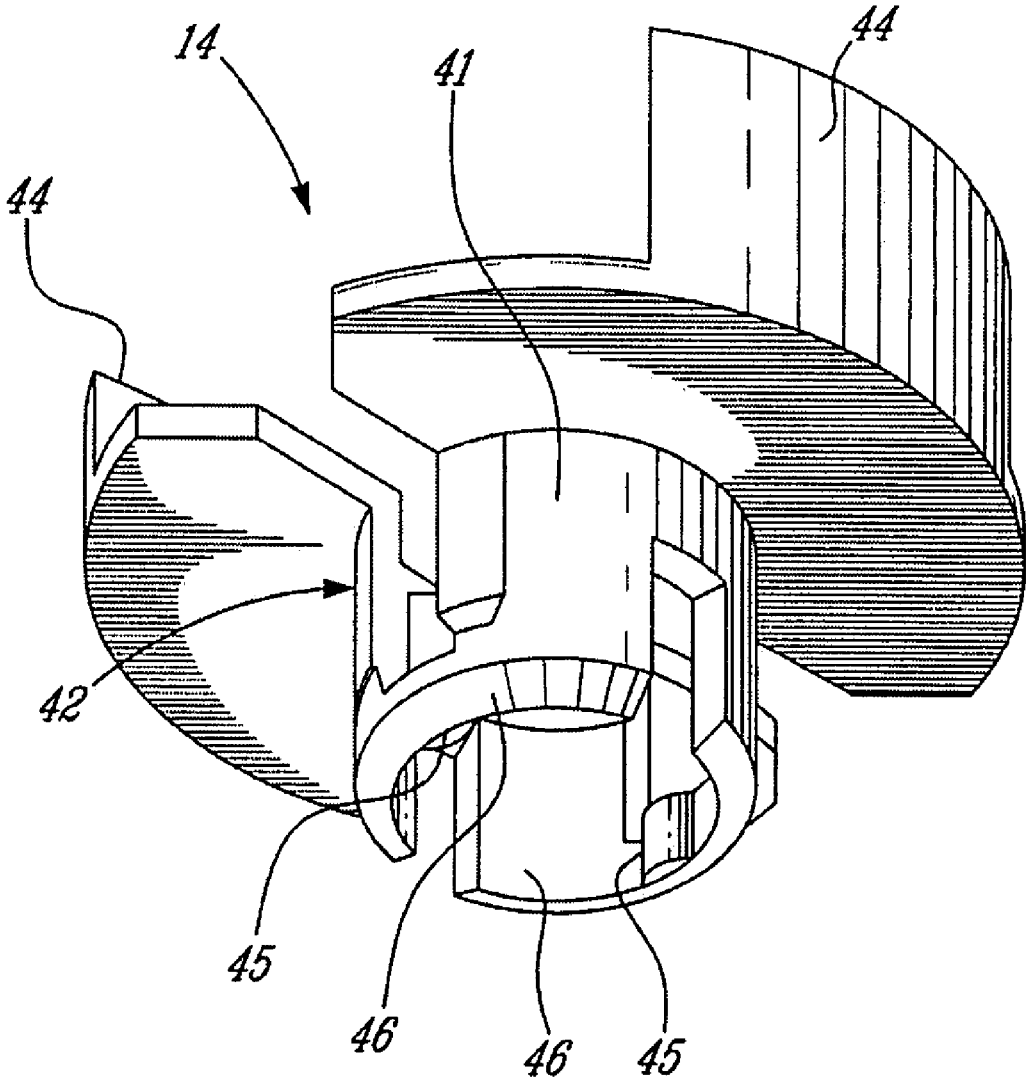
FIG. 6 is a perspective view of an indexing member of the luminaire socket of FIG. 1.

Referring to FIGS. 1 and 6, the rotor 14 has a pair of semi-annular walls 40. The semi-annular walls 40 are interconnected by an indexing member 41, and define a slot 42 therebetween. Semi-annular shoulders 43 are positioned between the walls 40 and the indexing member 41. Support walls 44 project upwardly from the semi-annular walls 40. As shown in FIG. 6, the indexing member 41 has a pair of bosses 45 for indexing an orientation of the rotor 14. The bosses 45 are on separate legs 46, whereby the bosses 45 can be spaced apart by temporarily bending the legs 46 away from one another.

Referring to FIG. 1, the cover 15 has a wall 50. Wedged fingers 51 project from the wall 50, and are provided for releasably securing the cover 15 to the body 12, in such a way that the plugs 13 are accommodated between the body 12 and the cover 15.

An indexing wheel 52 is positioned on the wall 50. Legs 53 extend away from a center of the indexing wheel 52. The legs 53 are separated by a slot 54. The legs 53 each have a semi-annular flange 55 at a free end. Depressions 56 are provided on opposite sides of the wall 50, and receive the eyelets 24 when the cover 15 is connected to the body 12.

Referring concurrently to FIGS. 1 to 6, when the cover 15 is secured to the body 12, the legs 53 are between the central contact portions 32 of the plugs 13 within the central opening 22A. The rotor 14 has an underface of the semi-annular walls 40 seated upon the surface 22 of the body 12, such that rotor 14 can rotate with respect to the body 12. The indexing member 41 of the rotor 14 is received in the central opening 22A of the body 12.

Therefore, the rotor 14 and the cover 15 are interconnected. More specifically, the semi-annular flanges 55 of the cover 15 are received in the semi-annular shoulders 43 of the rotor 14 such that the rotor 14 is held captive to the cover 15, while being free to rotate. However, when the rotor 14 and the cover 15 are interconnected, the indexing member 41 of the rotor 14 is operatively associated with the indexing wheel 52. More specifically, bosses 45 are received in appropriate depressions between cogs of the indexing wheel 52, whereby a rotation of the rotor 14 is indexed to the positions in which the bosses 45 are in the depressions.

Torque of sufficient magnitude causes the legs 46 to spread apart as the bosses 45 move to subsequent depressions in the indexing wheel 52.

Referring to FIG. 1, the support 16 is a bracket 60 having a connection base 61 by which the support 16 is secured to a surface, such as a wall or a ceiling. A backwall 62 is perpendicularly mounted to the base 61. The backwall 62 has a pair of tapped throughbores 63, so as to receive the fasteners 17, to secure the body 12 to the support 16.

A spring wall 64 is provided on the backwall 62. Accordingly, the spring wall 64 exerts pressure on the cover 15. Therefore, when the fasteners 17 secure the body 12 to the support 16, it is contemplated to provide some play such that the cover 15 is separated from the backwall 62. In such a case, the spring wall 64 biases the assembly of the body 12, the plugs 13, the rotor 14 and the cover 15 against the head of the fasteners 17.

Wings 65 are provided to further secure the support 16 to other parts of the luminaire.

Now that the various components of the luminaire socket 10 have been described, an installation of a light tube within a pair of luminaire sockets 10 is described.

Figure 9A:
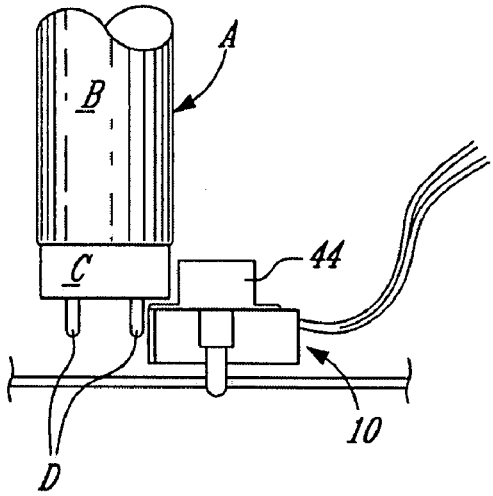
FIG. 9A is a schematic view illustrating a light tube being directed toward the luminaire socket for interconnection therewith.
Figure 9B:
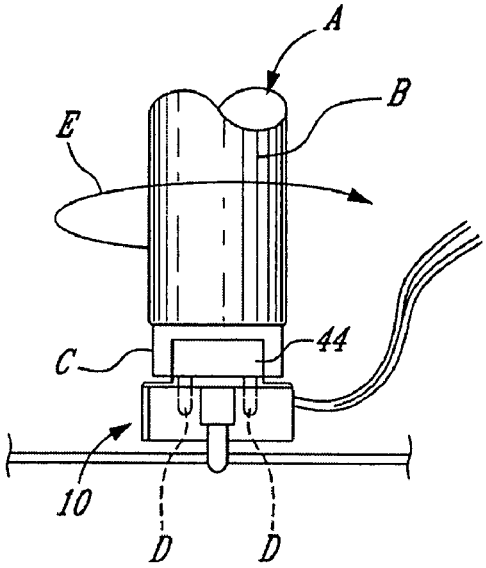
FIG. 9B is a schematic view illustrating the light tube being engaged in the luminaire socket.
Figure 9C:
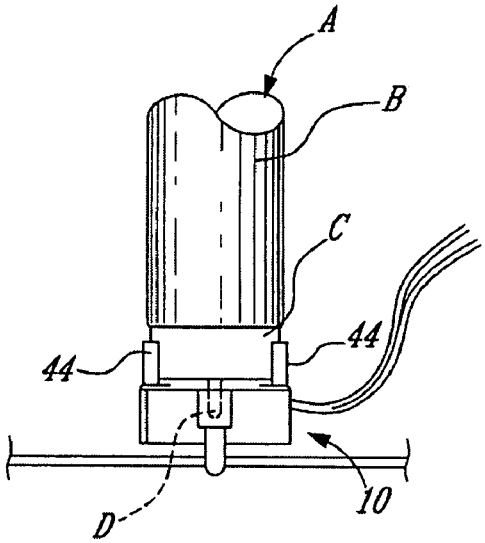
FIG. 9C is a schematic view illustrating the light tube being locked in the luminaire assembly.

Referring to FIGS. 9A to 9C, light tubes A have a tubular portion B with socket caps C at opposed ends (only one of which is shown in FIGS. 9A to 9C) and a pair of pins D on each socket cap C. The light tube A is then secured between a pair of sockets 10.

As shown in FIG. 9A, the light tube A is directed toward the sockets 10 so as to enter the pins D of the light tube in the opposed sockets 10. To perform this operation, the slot 42 of the rotor 14 (FIGS. 1 to 6), must be aligned with the slot 23 of the body 12 and the slot 54 of the cover 15. As shown from the exploded view of FIG. 1, the slots 23 and 54 are always aligned with one another.

Once the pins D are fully received in the central opening 22A of the body 12, as is illustrated in FIG. 9B, the socket cap C is against the surface of the semi-annular walls 40. The socket cap C is between the support walls 44 of the rotor.

It is pointed out that the play allowed by the spring walls 64 of the supports 16 facilitates the insertion of light tube A between sockets 10, for instance for light tubes having a length at upper limits of tolerances.

Referring to FIG. 9B, as indicated by arrow E, the light tube A is then rotated to engage the pins D against the central contact portions 32 of the plugs 13 (FIGS. 1 to 6). Some torque must be manually applied to rotate the light tube A in direction E, so as to oppose against the indexing mechanism consisting of the indexing member 41 and the indexing wheel 52 (FIGS. 1 to 6).

Therefore, clicking sounds from the indexing mechanism indicate to the user that the orientation of the light tube A within the sockets 10 is changing. It is contemplated to provide abutments in the indexing wheel 52 so as to prevent any rotation beyond 90 degrees of rotation from the initial alignment of the slots 23, 42 and 54 (FIG. 9A). In this orientation of the light tube A as illustrated in FIG. 9C, the pins D are in contact with the central contact portion 32 of the plugs 13, whereby the light tube A can be lit.

Referring to FIG. 9C, the pins D are accommodated within the central opening 22A of the body 12, whereby the light tube A is held captive by the pairs of pins D at its opposed ends being within the central opening 22A. Therefore, unless the slots 42 are in alignment with the slots 23 and 54, unlike in the illustration of FIGS. 2 and 3, the light tube A is held captive between the sockets 10. Moreover, as the indexing mechanism causes some restriction on the rotor 14, some torque must be applied to the light tube A for the light tube A to be rotated out of engagement with the sockets 10.

The support walls 44 add a level of safety, in that the support walls 44 would support the light tube A, for instance, during a breakage of the pins D. Hence, when the sockets 10 are installed, it is suggested to orient the sockets 10 such that one of the support walls 44 is vertically below the light tube A when the light tube A is in the operative position within the sockets 10 (as is shown in FIG. 9C).

The luminaire sockets in accordance with the various embodiments are advantageous, in that the safety support is deployed by the engagement of a light tube in the luminaire sockets. The luminaire socket 10 is configured so as to provide the support walls 44 upon rotational engagement of the light tube into electrical contact in the socket connector.

Other embodiments considered include a detent actuated by the translational engagement of the light tube into electrical contact. A spring-loaded support wall is released by the contact of the light tube on the detent. The spring-loaded support wall may then be retracted manually. The manual step required to retract the support wall (equivalent to the support walls 44 of FIG. 1), in combination with the biasing of the support wall to the support configuration advantageously ensure that the light tube will be supported during use.

Figure 7:
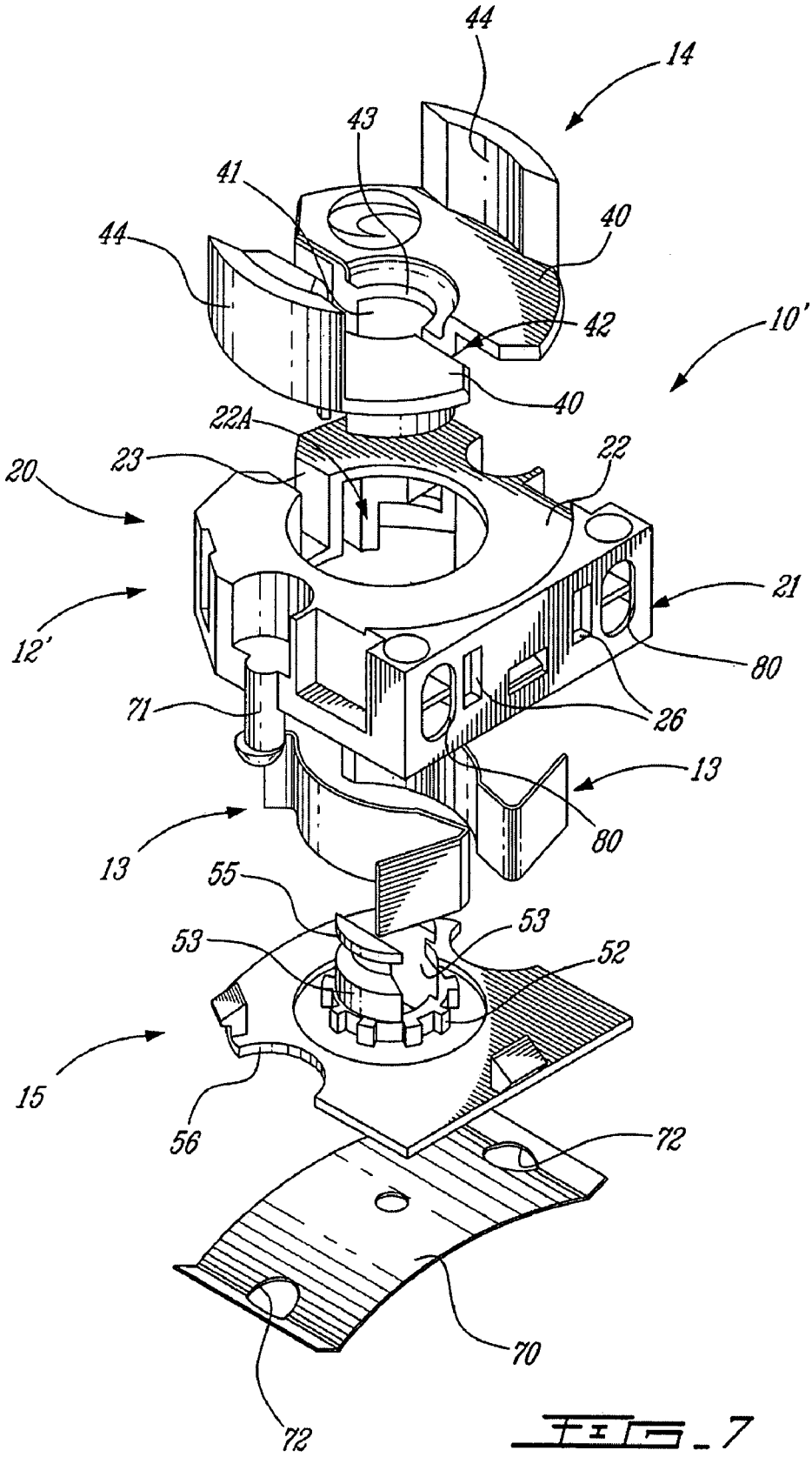
FIG. 7 is an exploded view of a luminaire socket constructed in accordance with another preferred embodiment of the present invention.
Figure 8:
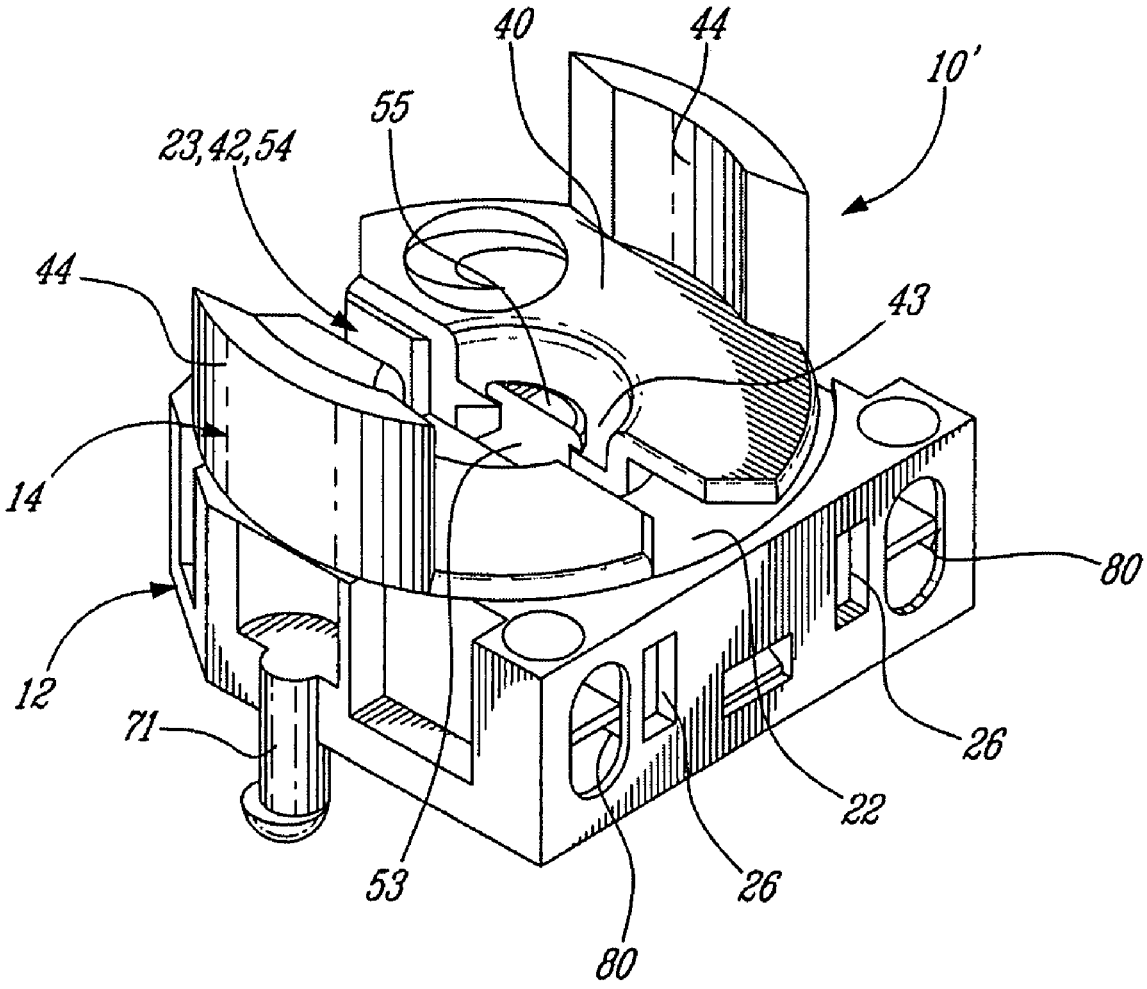
FIG. 8 is a perspective view of the luminaire socket of FIG. 7, as assembled.

Referring to FIGS. 7 and 8, a luminaire socket in accordance with another preferred embodiment is generally shown 10'. The luminaire socket 10 of FIGS. 1 to 6 and the luminaire assembly 10' of FIGS. 7 and 8 mostly have similar components, save for the support 16 of the luminaire assembly 10, simply replaced by a spring wall 70. Also, the base 12' has a pair of flanged-head connectors 71. The spring wall 70 serves a similar function as the spring wall 64 of the luminaire assembly 10. Throughbores 72 are provided in the spring wall 70 such that the flanged-head connectors 71 may be directly received in a support surface when the luminaire socket 10' is installed.

A variety of materials can be used to make the components of the socket 10. For instance, it is considered to use a non-flammable plastic material for the body 12, the rotor 14, the cover 15 and some parts of the support 16. The plugs 13 are typically made of a slightly flexible metal, such as brass (e.g., 4/4 brass) or beryllium. The spring wall 64 typically consists of a metal such as quenched steel.

It is contemplated to provide luminaire sockets 10 as described previously in different sizes and/or configurations in view of various types of tubular fluorescent lamps, such as T8 with G13 socket caps, T5 with G5 socket caps, and/or T12 with G13 socket caps.

Although the luminaire socket 10 is well suited for use in transit vehicles due to the presence of safety features, it is contemplated to use luminaire assemblies with luminaire sockets 10 in other applications, such as in commercial, industrial and residential buildings.

I claim:

1. A luminaire socket of the type used in spaced-apart pair to receive a light tube therebetween in a luminaire assembly, the light tube being of the type having socket caps with contact pins at opposed ends, wherein the luminaire socket comprises:

a base connected to a support surface;

electrical plugs within the base, the electrical plugs connected to a power source so as to provide power to the light tube;

a rotor rotatable with respect to the base, the rotor having a slot for receiving therein the contact pins of a light tube in a locking position in which the contact pins of the light tube are in electrical contact with the electrical plugs for actuation of the light tube, the rotor being rotatable at least between an entry position in which the slot is oriented for insertion of the contact pins of the light tube therein, and the locking position, in which the contact pins of the light tube are in electrical contact with the electrical plugs for actuation of the light tube; and at least one support wall on the rotor, the support wall being displaceable to a support position by engagement of the light tube in the luminaire socket so as to support the light tube when the light tube is accidentally disengaged from the rotor in the locking position.

2. The luminaire socket according to claim 1, further comprising an indexing mechanism between the rotor and the base, so as to index a rotation of the rotor with respect to the base.

3. The luminaire socket according to claim 1, wherein an opening for the entry of the contact pins in the slot of the rotor is closed in the locking position so as to block the contact pins in the slot.

4. The luminaire socket according to claim 1, wherein the rotor has a pair of the support walls, the support walls being diametrically opposed on the rotor such that one of the support walls is in the support portion whether the rotor is rotated clockwise or counterclockwise from the entry position to the locking position.

5. The luminaire socket according to claim 1, wherein the electrical plugs are peripherally positioned with respect to the slot in the rotor, with the electrical plugs being biased toward the slot to ensure electrical contact between the electrical plugs and the contact pins of the light tube in the locking position.

6. The luminaire socket according to claim 1, further comprising a spring between the base and the rotor, the spring biasing the rotor away from the base so as to enable a play between luminaire sockets to accommodate light tubes with length variations.

* * * * *